US008491339B2

(12) United States Patent
Matsumoto et al.

(10) Patent No.: US 8,491,339 B2
(45) Date of Patent: Jul. 23, 2013

(54) CARD ADAPTER

(75) Inventors: Yasuyoshi Matsumoto, Yamato (JP); Yuichi Hasegawa, Yokohama (JP); Mitsuhiro Tomita, Yamato (JP); Yuji Naito, Kanagawa (JP); Yoko Takeuchi, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 375 days.

(21) Appl. No.: 12/810,530

(22) PCT Filed: Dec. 29, 2008

(86) PCT No.: PCT/US2008/088475

§ 371 (c)(1),
(2), (4) Date: Sep. 8, 2010

(87) PCT Pub. No.: WO2009/086530

PCT Pub. Date: Jul. 9, 2009

(65) Prior Publication Data

US 2011/0003513 A1 Jan. 6, 2011

(30) Foreign Application Priority Data

| | | |
|---|---|---|
| Dec. 28, 2007 | (JP) | 2007-339299 |
| Dec. 28, 2007 | (JP) | 2007-339503 |
| Jun. 10, 2008 | (JP) | 2008-151210 |
| Jun. 10, 2008 | (JP) | 2008-151214 |

(51) Int. Cl.
*H01R 24/00* (2011.01)

(52) U.S. Cl.
USPC ..... 439/630

(58) Field of Classification Search
USPC ..... 439/630, 638
See application file for complete search history.

(56) References Cited

U.S. PATENT DOCUMENTS

| | | | | |
|---|---|---|---|---|
| 5,755,588 | A * | 5/1998 | Sweatman et al. | 439/369 |
| 5,921,385 | A | 7/1999 | Plutz et al. | |
| 7,308,771 | B2 * | 12/2007 | Memelink | 40/649 |
| 7,320,622 | B2 * | 1/2008 | Ying et al. | 439/630 |
| 7,364,468 | B2 * | 4/2008 | Liu et al. | 439/638 |
| 8,047,363 | B2 * | 11/2011 | Sheba et al. | 206/307 |

FOREIGN PATENT DOCUMENTS

| | | |
|---|---|---|
| DE | 296 15 553 | 10/1996 |
| EP | 0 629 111 A1 | 12/1994 |
| EP | 0 967 571 A2 | 12/1999 |
| EP | 1 594 191 A1 | 11/2005 |
| JP | 2003-032829 | 9/2004 |
| WO | PCT/JP2006/0309295 | 11/2006 |
| WO | PCT/JP2007/0073811 | 6/2009 |

OTHER PUBLICATIONS

International Search Report for PCT/US2008/088475.

* cited by examiner

*Primary Examiner* — Xuong Chung Trans
(74) *Attorney, Agent, or Firm* — Timothy M. Morella

(57) ABSTRACT

A card adapter (10) is configured to receive a first card (20) and to be inserted into a card connector (1) into which a second card may be mated. The card adapter includes a housing having first (120) and second (110) intermateable insulative plate members and a circuit member (130) arranged in the housing. The circuit member includes a plurality of adapter side contact pads (136), each being configured to contact a terminal of the card connector, and a plurality of conductive leads (133), each lead extending between one of the adapter side contact pads and a termination end (134, 135). A plurality of connection terminals (150) are provided with each being interconnected to one of the termination ends of the conductive leads and configured to engage a contact pad (251) of the first card. The first plate member may include a plurality of deformable projections (127) configured to engage a first surface of the circuit member and press the circuit member against the second plate member. The circuit member may have a plurality of through-holes with the terminals having solder tails that extend into the through holes.

18 Claims, 14 Drawing Sheets

CARD ADAPTER

BACKGROUND OF THE INVENTION

The present invention relates to a card adapter and, more particularly, a highly reliable card adapter for receiving a first memory card and connecting to an electrical connector configured to receive a second memory card.

Diverse electronic appliances and devices such as a personal computers, cell phones, PDA's (Personal Digital Assistants), digital cameras and vehicular navigation systems include a card connector, respectively, which is adapted for using various types of memory cards including SIM (Subscriber Identity Module) cards, MMC® (Multi Media Card), SD® (Secure Digital) cards, miniSD® cards, xD-Picture Cards®, Memory Sticks®, Memory Stick Duo®, SmartMedia®, T-Flash (Trans-Flash) memory cards, and microSD® cards.

In recent years, as electronic devices and appliances have become more diversified, memory cards also tend to become more diversified. Therefore, card connectors have been proposed that can receive not only a single type but also multiple types of memory cards. Such card connectors are rather large and difficult to mount especially on electronic devices of small size. Hence, a card adapter has been proposed that enables a memory card to be mated to a card connector compatible with other types of memory cards (for example, refer to Japanese Patent Laid-Open (Kokai) Application 2006-32097).

Referring to FIG. 15, a card adapter includes lower cover 910 having lower plate 911 and upper case 920 having an upper plate 921. The card adapter has a molded insert member 930 integrally formed with a plurality of terminal members 950 having one end configured to engage contact pads on a memory card (not shown) and the other end configured interconnect to terminals (not shown) of a card connector (not shown). The molded insert member 930 is fixed between the lower cover 910 and the upper cover 920. A cover 940 is pivotably mounted on the molded insert member 930.

With a memory card loaded in a space between the lower case 910 and the upper case 920 and the cover 940 closed, the card adapter may be mated to the card connector in order to electrically connect the contact pads on the memory card with the terminals of the card connector via the terminal member 950.

The conventional card adapter holds the molded insert member 930 by sandwiching it between lower cover 910 and upper cover 920. This adds to the overall thickness of the conventional card adapter and makes it sometimes difficult to insert such a conventional card adapter into a card connector that is compatible with low-profile, small memory cards. The molded insert member 930 may be integrally formed with the terminal members 950 in order to electrically connect the contact pads of the memory card with the terminals of the card connector and, as such, covers the circumference of the terminal members 950. This substantially adds to the thickness of the molded insert member 930 and, as a result, the overall thickness of the conventional card adapter

SUMMARY OF THE INVENTION

Therefore, it is an object to solve the above-mentioned problem encountered by the conventional card adapter through the provision of a reliable card adapter having a low-profile design attained by arranging a thin circuit member having conductive traces thereon within a housing. A plurality of tapered projections are formed on the inner surface of the housing whereby the card adapter is compatible with card connectors for small type of cards, and is capable of stably holding a circuit member and maintaining electrical continuity and connection between a card and a card connector.

In order to achieve the above-mentioned object, a card adapter is configured to accommodate a first card in a housing formed by combining a first plate member with a second plate member and to be mated to a card connector to which a second card is mated. The card adapter includes a plurality of connection terminals arranged in the housing and configured to engage contact pads of the first card and a wiring board located in the housing, wherein the wiring board comprises includes adapter side contact pads configured to engage terminals of the card connector; and leads configured to connect the connection terminals to the adapter side contact pads. The first plate member includes a plurality of projections which engage the first surface, and press the wiring board against the second plate member via the projections.

A card adapter according to another aspect is provided, wherein the first plate member includes a board receiving part formed for receiving at least a part of the wiring board and, wherein the wiring board is arranged such that the second surface thereof is abutted against a surface of the board receiving part thereby being arranged in position in a thickness direction of the housing. A card adapter according to a further aspect may include at least a portion of each of the projections being deformable. In still a further aspect, each of the projections may have a sharp tip.

A card adapter according to still a further aspect may provide that all of the projections have central axes thereof which are inclined in an identical direction. In a further aspect, the plurality of projections may be arranged in grid-like pattern. In a further aspect, the tip of each of the projections may be deformed due to application of ultrasonic vibrations for coupling the first plate member and the second plate member.

A card adapter is configured to receive a first card and to be inserted into a card connector into which a second card may be mated. The card adapter includes a housing having first and second intermateable insulative plate members and a circuit member arranged in the housing. The circuit member includes a plurality of adapter side contact pads, each being configured to contact a terminal of the card connector, and a plurality of conductive leads, each lead extending between one of the adapter side contact pads and a termination end. A plurality of connection terminals are provided with each being interconnected to one of the termination ends of the conductive leads and configured to engage a contact pad of the first card. The first plate member may include a plurality of deformable projections configured to engage a first surface of the circuit member and press the circuit member against the second plate member. The circuit member may have a plurality of through-holes with the terminals having solder tails that extend into the through holes.

If desired, the first plate member may be made of an insulative material. If desired, the circuit member may be a circuit board. If desired, the second plate member may include a board receiving recess for receiving at least a part of the circuit member, and the circuit board may abut a reference surface of the board receiving recess thereby positioning the circuit member in a thickness direction of the housing. If desired, at least a portion of each of the projections may be deformable. If desired, each of the projections may have a sharp tip. If desired, each of the projections may have a central axis that is inclined in an identical direction. If desired, the plurality of projections may be arranged in grid-like pattern.

If desired, a tip of each of the projections may be deformed due to application of ultrasonic vibrations for coupling the first plate member and the second plate member.

If desired, the connection terminals may include a base held by an insulative terminal holding member, a resilient spring arm having one end thereof fixed to the base and another free end thereof having the contact end thereon. A board connection part may be connected to one end of the base opposite to another end to which the spring arm is connected, and the board connection part may include the solder tail. If desired, the board connection part may include a horizontal part having one end thereof connected to the solder tail and extending substantially parallel to a first surface of the circuit member, and the spring arm extending from the base at an angle so that the contact end approaches one of the first and second plate members.

If desired, the board connection part may further include a transition section having one end thereof connected to the base and a second end connected to the horizontal part. The transition section may extend along an insertion direction of the first card and the board connection part may be generally U-shaped. If desired, the first plate member may include a board receiving recess for receiving at least a part of the circuit member therein, and the circuit member may be arranged such that a second surface thereof abuts a surface of the board receiving recess to align the circuit member in a thickness direction of the housing.

The invention can be better understood with reference to the following drawings. The components in the drawings are not necessarily to scale, emphasis instead being placed upon clearly illustrating the principles of the present invention.

DESCRIPTION OF THE PREFERRED EMBODIMENTS

Figure 1:
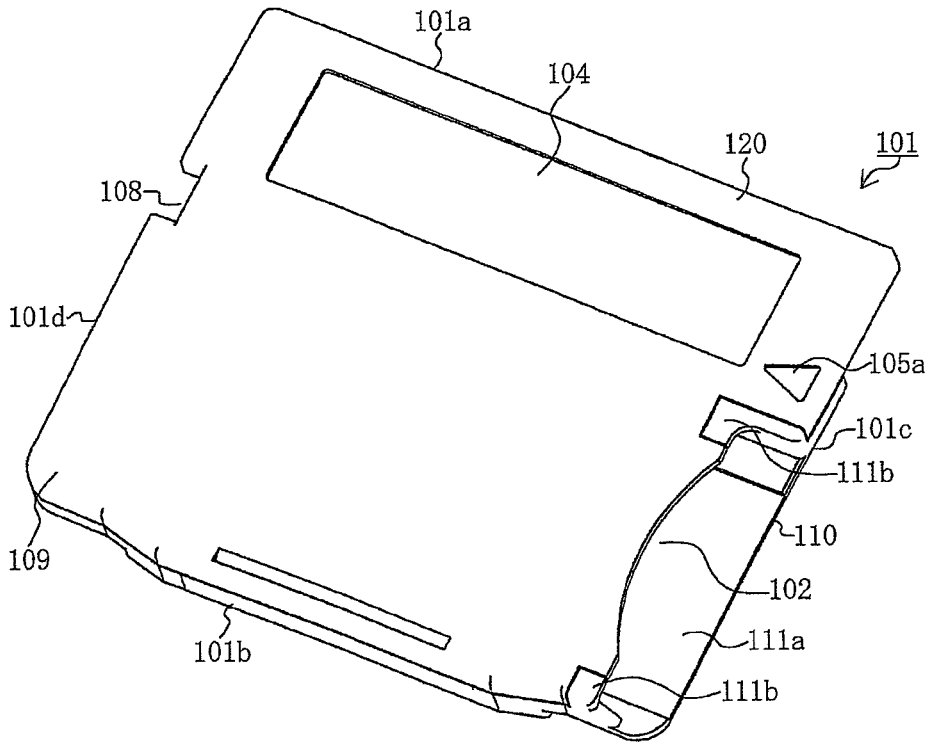
FIG. 1 is a perspective view of a card adapter according to the embodiment of the present invention, viewed from above.

Preferred embodiments are described in detail below with reference to the accompanying drawings in which like reference numerals designate corresponding components throughout the several views.

Figure 2:
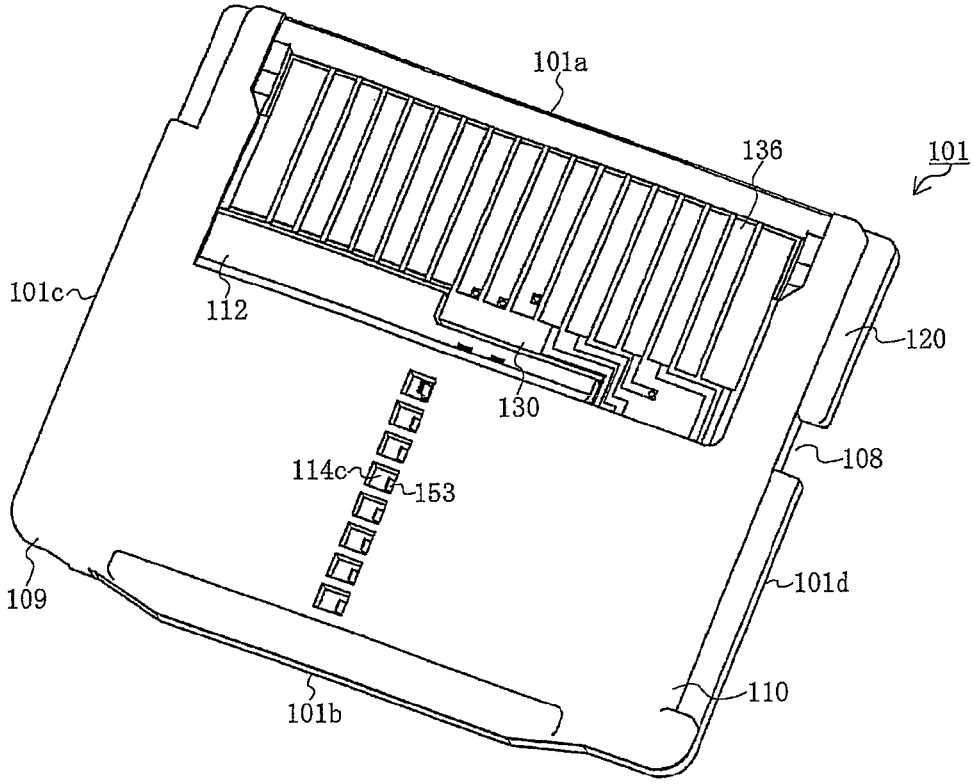
FIG. 2 is a perspective view of the card adapter of FIG. 1, viewed from below.
Figure 3:
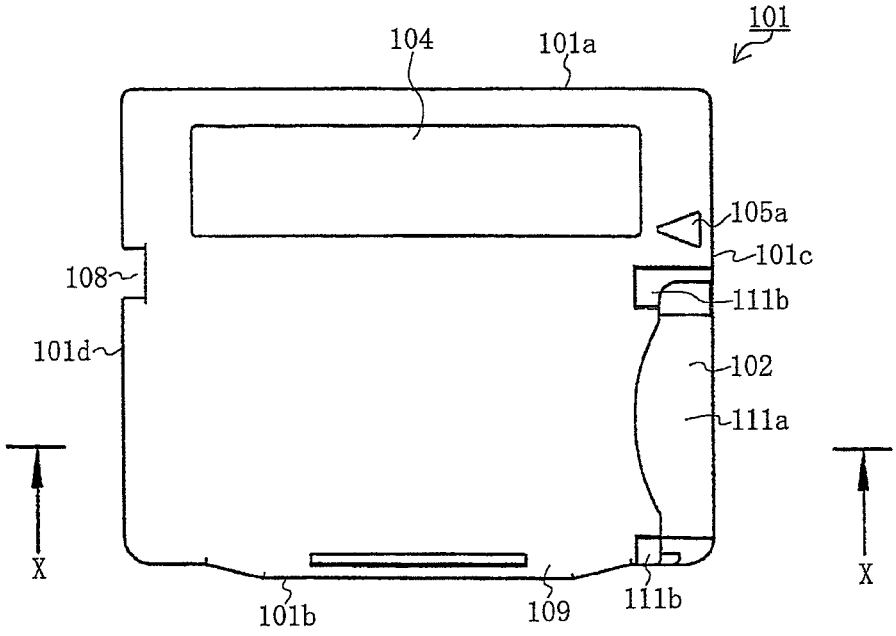
FIG. 3 is a top plan view of the card adapter of FIG. 1.

Referring to the FIGS. 1-3, card adapter 101 is configured to receive a first card 201 therein and the combination may be inserted into a card connector 1 (FIG. 14) according to the present embodiment. The card connector 1 is a connector with which a second card (not shown) may be mated and such connector is mounted on an electronic appliance or device (not shown). When the second card is mated to the card connector 1, the second card is inserted into the electronic appliance via the card connector 1. When the card adapter 101 into which the first card 201 is inserted is mated to the card connector 1, the first card 201 is inserted into the electronic device via the card connector 1 and the card adapter 101. While the electronic appliance or device with which card adaptor 101 is, used may be, for example, a personal computer, a cell phone, a PDA, a digital camera or a navigation system for vehicles, the electronic appliance may be any type of device or appliance.

While the first card 201 and the second card are, for example, IC cards such as SIM (Subscriber Identity Module) cards, MMC® (Multi Media Card), SD® cards, miniSD® cards, xD-Picture Cards®, Memory Stick®, Memory Stick Duo®, Smart Media®, T-Flash memory cards, and microSD® cards, and may be of any type, the first card 201 is a card of a smaller type than the second card. In this example, the first card 201 is a microSD® card and the second card is an xD-Picture Card®.

In this embodiment, representations of directions such as up, down, left, right, front, rear, and the like, used for explaining the structure and movement of each part of the card adapter 101, first card 201 and the card connector 1 are not absolute, but relative. These representations are appropriate when the card adapter 101, first card 201 and the card connector 1 or their parts are in the position shown in the figures. If the position of the card adapter 101, first card 201 and the card connector 1 or their parts changes, however, it is assumed that these representations are to be changed according to the change in position of the card adapter 101, first card 201 and the card connector 1 or their parts.

The card adapter 101 has an upper cover 120 as a first plate member that is a generally planar member integrally formed of an insulating material such as a synthetic resin and a lower cover 110 as a second plate member that is a generally planar member integrally formed of an insulating material such as a synthetic resin in a similar manner. The housing 109 of the card adapter 101 is formed by securing the upper cover 120 and the lower cover 110 together as is know in the art.

The card adapter 101 is mated to the card connector 1 in a manner similar or identical to the manner in which the second card is mated. Thus, the card adapter 101 has a similar external shape and dimensions to those of the second card. As described above, in this embodiment, the second card is an xD-Picture Card® so that its dimensions are 20 mm in length, 25 mm in width and 1.7 mm in thickness. The card adapter 101 is 20 mm long (that is, the space between front end 101*a* and rear end 101*b*), 25 mm wide (that is, the space between right side 101*c* and left side 101*d*), and 1.7 mm thick (that is, the space between the outer surface of the upper cover 120 and the outer surface of the lower cover 110).

A display part 104 is formed in close proximity to the front end 101*a* on the outer surface of the upper cover 120. The display part 104 is a flat-shaped rectangular part used to display, for example, various types of information such as a product's name, a manufacturer's name, and precautions, or various types of figures such as a simple pattern and design. Display of such information or figures may be made through direct printing on the display part 104 or through the application of a seal member of the shape of a sheet on the display part 104. The display part 104 may be omitted if desired.

A rectangular recess 108 is formed at the left side 101*d* of the card adapter 101. The recess 108 engages an engaging projection part of a slide member of the card connector 1. At the recess 108, the upper cover 120 protrudes leftward beyond the lower cover 110 so that the recess 108 is formed only on the upper cover 120.

A card receiving receptacle 102 opens at the right side 101*c* of the card adapter 101 so that the first card 201 is inserted from the right side 101*c* into the card receiving receptacle 102. Thus, a first insertion indication mark 105*a* is provided for indicating the insertion direction of the first card 201 and is formed on the outer surface of the upper cover 120 in close proximity to the right side 101*c* near card receiving receptacle 102.

As shown in FIGS. 8A-8H an inner board 130 such as a circuit board board, an inner terminal unit 140, and a card locking bracket 161 are arranged between the upper cover 120 and the lower cover 110. The first card 201 is inserted and received inside the card receiving receptacle 102 defined between the upper cover 120 and the lower cover 110.

Figures 4A, 4B, 4C:
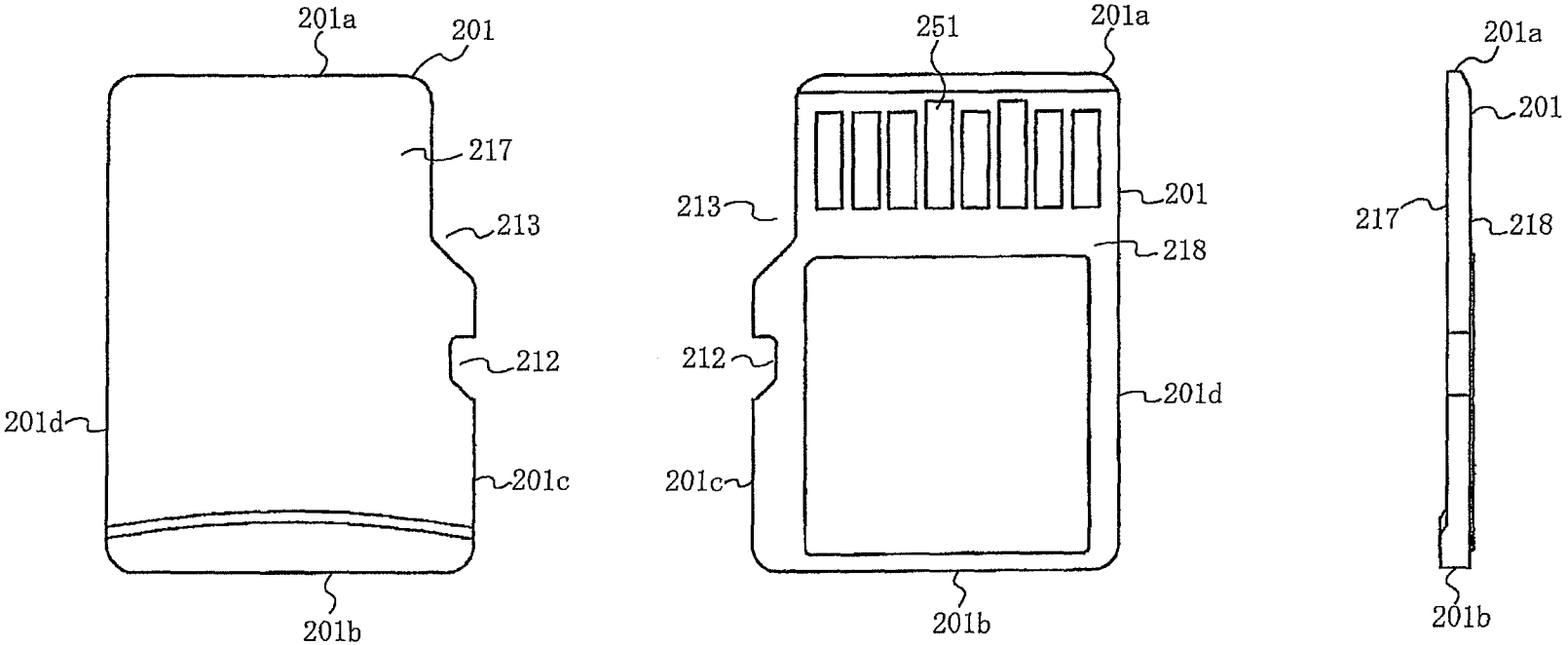
FIG. 4A is a top plan view of a memory card to be inserted into the card adapter of FIG. 1.
FIG. 4B is a bottom view of the memory card of FIG. 4A.
FIG. 4C is a side view of the memory card of FIG. 4A.

As described above, in this embodiment, the first card 201 is a microSD® card and has a shape of a substantially rectangular plate shown in FIG. 4. First card 201 has is 15 mm long (that is, the space between front end 201*a* and rear end 201*b*), 11 mm wide (that is, the space between right side 201*c* and left side 201*d*), and 0.7 mm thick (that is, the space between upper surface 217 and lower surface 218). A plurality of (eight in the illustrated example) conductive contact pads 251 are arranged side by side near and along the front end 201*a* of the lower surface 218 of first card 201.

A recess 212 is formed at the right side 201*c* of the first card 201 and a front notch 213 is formed near the front end 201*a*. The recess 212 is configured to engage an engaging projection part 161*a* of the card locking bracket 161. The front notch 213 is provided by cutting into the corner formed at the front end 201*a* and the right side 201*c* of the first card 201 over a predetermined range and has a substantially trapezoidal shape. This forms a narrow leading edge near the front end 201*a* of the first card 201 so that the front end 201*a* has a smaller width than the rear end 201*b*. The width dimension of the narrow part is 9.7 mm.

Figures 8A, 8B, 8C, 8D, 8E, 8F, 8G, 8H:
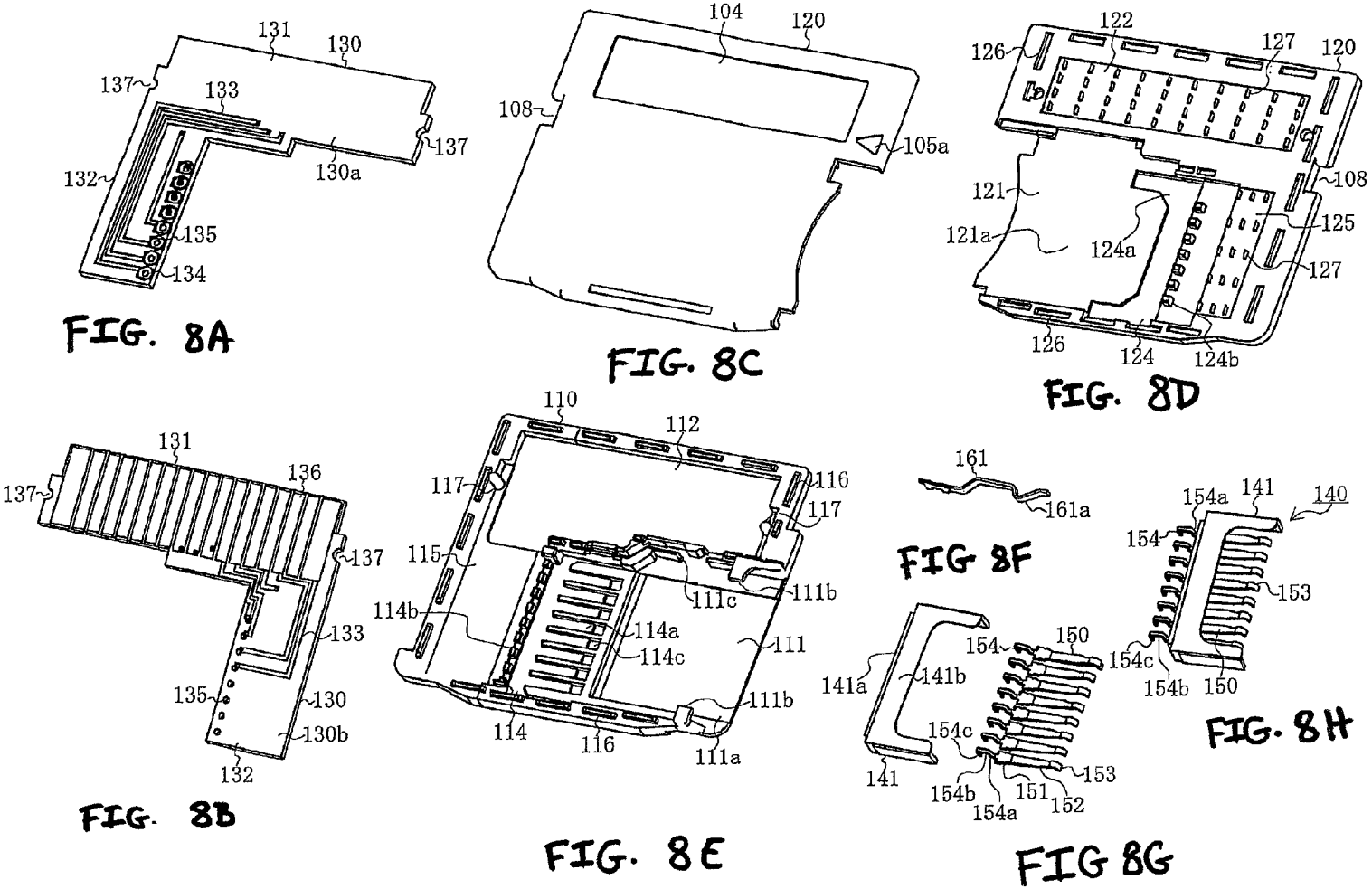
FIG. 8A is a perspective view of an inner board of the card adapter of FIG. 1, illustrating an upper surface of the inner board.
FIG. 8B is a perspective view of the inner board of FIG. 8A illustrating a lower surface of the inner board.
FIG. 8C is a perspective view of an upper cover of the card adapter of FIG. 1, illustrating an outer surface of the upper cover.
FIG. 8D is a perspective view of the upper cover of FIG. 8C, illustrating an inner surface thereof.
FIG. 8E is a perspective view of a lower cover of the card adapter of FIG. 1, illustrating an inner surface thereof.
FIG. 8F is a perspective view of a card locking bracket of the card adapter of FIG. 1.
FIG. 8G is a perspective view of an inner terminal unit of the card adapter of FIG. 1, illustrating a state in which the inner terminal unit is disassembled.
FIG. 8H is a perspective view of the inner terminal unit of FIG. 8G, illustrating a state in which the inner terminal unit is assembled.

As shown in FIG. 8E, the lower cover 110 of the card adapter 101 includes, on the inner surface thereof, a card receiving receptacle 111, a pad corresponding opening 112, a terminal receiving area 114, and a board receiving part 115 for receiving at least a portion of an inner board 130. As shown in FIG. 8D, the upper cover 120 of the card adapter 101 includes, on the inner surface thereof, a card receiving area 121, a pad corresponding recess 122, a terminal receiving area 124, and a board receiving area 125 for receiving at least a portion of the inner board 130.

Furthermore, the card receiving receptacle 111 of the lower cover 110 includes a card receiving base plate 111*a* facing the second surface 218 of the first card 201, card retaining parts 111*b* arranged on both sides of the card receiving base plate 111*a*, and a bracket receiving recess part 111*c* formed in a position facing the right end 201*a* of the first card 201. The card receiving part 121 of the upper cover 120 includes a card receiving top plate 121*a* facing the upper surface 217 of the first card 201. When the upper cover 120 and the lower cover 110 are secured together, the space between the card receiving base plate 111*a* and the card receiving top plate 121*a* serves as a main portion of the card receiving receptacle 102.

Figure 5:
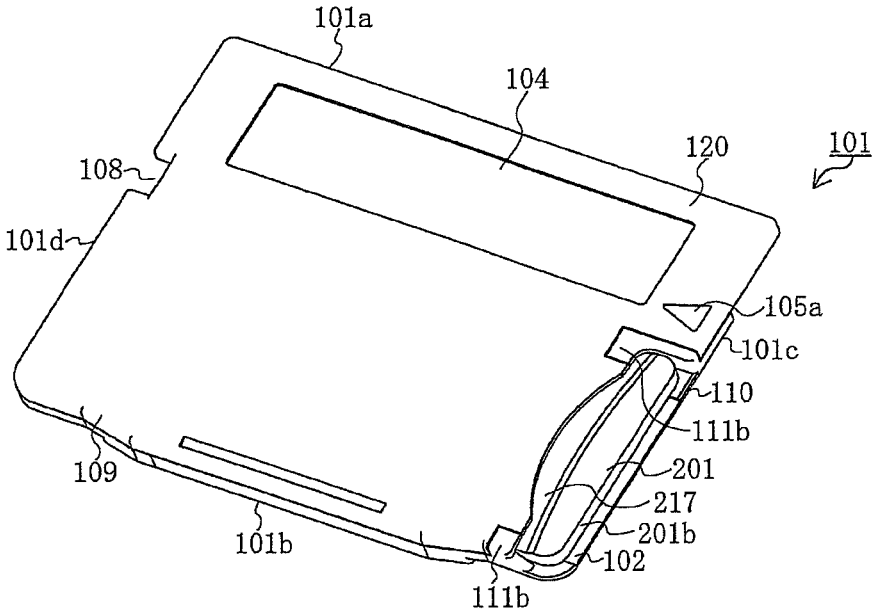
FIG. 5 is a perspective view of the card adapter similar to FIG. 1 but with the memory card of FIG. 4A inserted therein.
Figure 6:
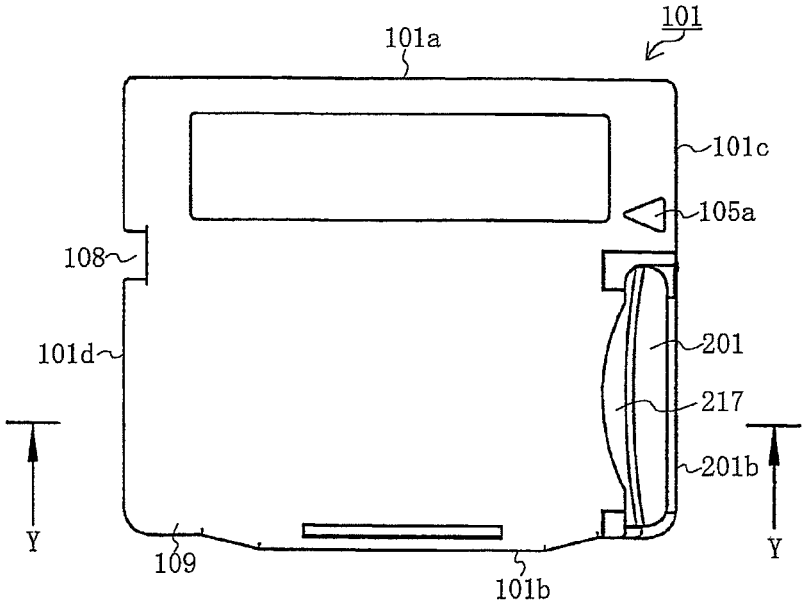
FIG. 6 is a top plan view of the card adapter similar to FIG. 3 but with the memory card of FIG. 4A inserted therein.

The card retaining parts 111*b* are formed substantially perpendicular to the card receiving base plate 111*a*. The upper end of each card retaining part 111*b* is formed into a visor-shape substantially parallel to the card receiving base plate 111*a* and protrudes from each side of the card receiving base plate 111*a* toward the interior thereof. As shown in FIG. 5, the lower surface of each of the visor-shape parts faces the upper surface 217 and at a portion of one is in proximity to the right side 201*c* and a portion of the other is in proximity to the left side 201*d* of the first card 201 inserted into the card receiving receptacle 102. That is, movement in the thickness direction of first card 201 into the card receiving receptacle 102 is restricted by each card retaining part 111*b*. The upper end surface of the card retaining part 111*b* is substantially flush with the outer surface of the upper cover 120 after the upper cover 120 and lower cover 110 are secured to each other.

A card locking bracket 161 is received in the bracket receiving recess part 111*c*. The card locking bracket 161 is an elastically deformable member formed by stamping and forming sheet metal. The engaging projection part 161*a* of the card locking bracket 161 protrudes from an opening formed in the side wall of the bracket receiving recess part 111*c* toward the interior of the card receiving base plate 111*a* and is configured to engage recess 212 of a first card 201 received in card receiving receptacle 102 in order to lock first card 201 in receptacle 102. In other words, the engaging projection part 161*a* prevents a first card 201 received in the card receiving receptacle 102 from being pulled out of the receptacle.

The terminal receiving area 114 of the lower cover 110 includes a plurality of terminal receiving grooves 114*a* a, a plurality of stop projections 114*b*, each being formed as a projection-shaped stop member, and a plurality of terminal tip receiving recesses 114*c*. The terminal receiving part 124 of the upper cover 120 includes a recess 124*a* and a plurality of stop projections 124*b*. When the upper cover 120 and the lower cover 110 are secured together, a space is defined between the terminal receiving parts 114 and 124 and an inner terminal unit 140 is secured in the space.

As shown in FIGS. 8G and 8H, the inner terminal unit 140 includes card connection terminals 150 and a molded housing 141 to hold card connection terminals 150. Each of the card connection terminals 150 is arranged to engage a contact pad of the first card 201, namely, a contact pad 251, and is an integrally formed spring-like member made by stamping and forming conductive sheet metal. Each card connection terminal 150 includes a base 151 press-fit into a holding groove (not shown) in housing 141, a cantilever-shaped spring arm 152 having one end connected and fixed to the base 151, the other end, that is, being a free end that is elastically displaceable in a vertical direction, and a contact portion 153 disposed on the free end of arm 152 and configured to engage or contact a corresponding contact pad 251 of a first card 201 positioned in card receiving receptacle 102.

Card connection terminals 150 further include a board connection part or solder tail 154 extending from base 151 opposite spring arm 152 and soldered to the inner board 130. Each solder tail 154 is a rod-shaped component having an inverse U-letter shape. The solder tail 154 includes a transition portion 154*a* having a lower end connected to the base 151 and extending in the thickness direction of a housing 109 and upward from the base 151, a horizontal portion 154*b* having a base end connected to the upper end of the transition portion 154*a* and extending substantially parallel to the base 151, and an insertion part 154*c* having an upper end connected to a tip of the horizontal portion 154*b* and extending in a thickness direction of the housing 109. In other words, the insertion part 154*c* extends downward substantially perpendicularly to the base 151, is inserted into one of through-holes 135 extending through inner board 130 in its thickness direction, and is soldered to and electrically connected to wires 133.

Housing 141 is integrally formed of an insulating material such as a synthetic resin. The housing includes a plurality of terminal receiving or holding grooves (not shown) formed on the lower surface of a body portion 141*a* into which base 151 of each card connection terminal 150 is inserted. A plurality of (eight in the illustrated example) card connection terminals 150 are held in a side by side manner by the body portion 141*a* of the housing to form inner terminal unit 140 as shown in FIG. 8H. The number and pitch of the card connection terminals 150 may be changed as required so as to correspond to the number and pitch of the contact pads 251 of the first card 201.

When the inner terminal unit 140 is inserted into the space formed between the terminal receiving parts 114 and 124, an upper end 141*b* of housing 141 is received in molded part receiving recess part 124*a* of the upper cover 120. The base 151 of each card connection terminal 150 is positioned adjacent to the inner surface of the lower cover 110 outside the inner board 130. The arm 152 and the contact portion 153 are respectively accommodated in a plurality of terminal receiving grooves 114*a*. The arm 152 extends diagonally upward from the base 151, that is, in a direction towards upper cover 120. The terminal tip receiving recess 114*c* is formed to be recessed deeper into terminal receiving groove 114*a* than the terminal receiving groove part 114*a* itself and accommodates the tip of the abutting part 153. While the bottom portion of the terminal tip receiving recess 114*c* is formed to penetrate the lower cover 110 in the illustrated example and the tip of the contact portion 153 is visible from the lower surface of the card adapter 101 as shown in FIG. 2, the bottom portion of the terminal tip receiving recess part 114*c* does need to penetrate the lower cover 110.

In the illustrated example, the inner board 130 has a substantially L-shape and includes a first part 131 used to connect to the card connector 1 and a second part 132 used to connect to the first card 201. When the upper cover 120 and the lower cover 110 are secured together, a board receiving space is formed between the terminal receiving part 125 of the upper cover 120 and the terminal receiving part 115 of the lower cover 110 and the second part 132 is received in such board receiving space. The first part 131 is received between the pad corresponding recess 122 of the upper cover 120 and the pad corresponding opening 112 of the lower cover 110.

The inner board 130 includes an insulating layer formed by laminating, on a base material such as a glass fiber or carbon fiber, one or a plurality of materials comprised of a composite material such as a prepreg impregnated with an epoxy resin or one or a plurality of materials made of minerals or inorganic materials such as ceramics, and thin-film-shaped conductive traces, formed on the surface thereof. The conductive traces are comprised of a conductive metal by way of a technique such as etching, vapor deposition, printing or the like. If the insulating plate material includes a plurality of layers, the conductive trace may be formed between adjacent layers in the insulating plate material. In the illustrated example, a plurality of leads 133 as conductive traces and lands 134 formed on the periphery of through-holes 135 are formed on the upper surface of the inner board 130, that is, on the first surface 130*a*. A plurality of leads 133 as conductive traces and a plurality of contact pads 136 are formed on the lower surface of the inner board 130, that is, on the second surface 130*b*. When inner board 130 is attached to card adapter 101, the first surface 130*a* faces the inner surface of the upper cover 120 and the second surface 130*b* faces the inner surface of the lower cover 110.

Figure 7:
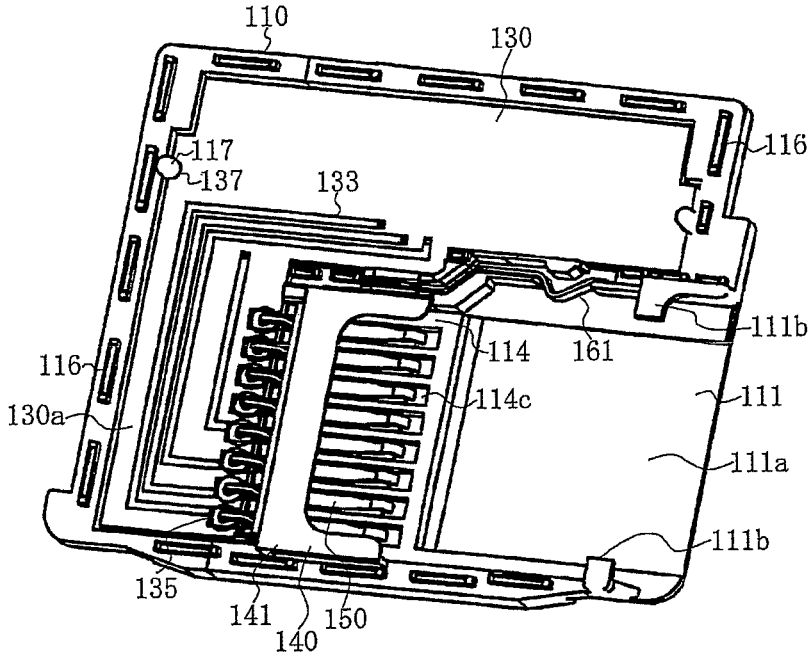
FIG. 7 is a perspective view of the card adapter of FIG. 1 with the upper cover removed.

Through-holes 135 have a conductive coating formed on the inner surface thereof and the conductive coating is connected to the land 134. As shown in FIG. 7, the solder tail 154 of each card connection terminal 150 has an insertion part 154*c* inserted into a corresponding through-hole 135 from the first surface 130*a* and is connected thereto using a conductive binder such as solder or a conductive adhesive. In this case, it is desirable that the conductive binder extend into through-hole 135 and the space between the peripheral surface of the insertion part 154*c* and the inner surface of through-hole 135 be filled with a conductive binder.

The number and pitch of the through-holes 135 may be changed as required so as to correspond to the number and pitch of the card connection terminals 150. Each lead 133 is connected to the conductive coating of the through-hole 135 directly or via the land 134. The insertion part 154*c* connected to the through-hole 135 is connected to a corresponding lead 133. Each lead 133 is connected to a contact pad 136 by way of a via (not shown). Thus, the solder tail 154 of each card connection terminal 150 is connected to a corresponding adapter side contact pad 136 via the through-hole 135 and lead 133. The number and pitch of the adapter side contact pads 136 is set to match the number and pitch of the card side contact pads (not shown) of the second card.

In the illustrated example, the number of the adapter side contact pads 136 is eighteen although the number and pitch of the adapter side contact pads 136 may be changed as required so as to correspond to the number and pitch of terminal 51 (FIG. 14) of card connector 1 and to the number and pitch of the card side contact pads of the second card. The adapter side contact pads 136 and the card connection terminals 150 do not need to be mutually connected on a one-to-one basis. For example, if the number of the adapter side contact pads 136 is larger than the number of card connection terminals 150, all adapter side contact pads 136 need not be connected to a card connection terminal 150. The number of leads 133 and routing are set in accordance with the form of connection between the adapter side contact pad 136 and the adapter inside card connection terminal 150.

When inner board 130 is mounted inside the card adapter 101, the adapter side contact pads 136 are exposed outside the card adapter 101 through the corresponding pad opening 112 of the lower cover 110 as shown in FIG. 2. When the card adapter 101 is mated to the card connector 1, the terminals 51 of the card connector 1 are arranged to contact the adapter side contact pads 136 and thus be electrically connected thereto.

From the viewpoint of maintaining contact between the terminals 51 and the adapter side contact pads 136, the position of the adapter side contact pads 136 with respect to the thickness or vertical direction of the card adapter 101 is important.

Positioning of the inner board 130 with respect to the thickness direction inside the card adapter 101 is achieved by using the second surface 130*b* (FIG. 8B) where the adapter side contact pad 136 is formed as a reference plane. The surface of the board receiving part 115 on the lower cover 110 is used as a reference plane on the side of the card adapter 101. The second surface 130*b* abuts against the surface of the board receiving part 115 and the inner board 130 is pressed against the lower cover 110 by the upper cover 120 to position the inner board 130 with respect to the thickness direction of the card adapter 101.

A plurality of board pressing projections 127 are formed on the board receiving part 125 of the upper cover 120 and protrude toward the lower cover 110. At least a portion of the board pressing projections 127 are deformable and include a sharp tip for that purpose. These deformable tips are desirable in case there are variations in the thickness of the inner board 130 so that the second surface 130*b* of the inner board 130 abuts against the surface of the board receiving part 115 of the lower cover 110 whereby possible variations in the spacing between the first surface 130*a* of the inner board 130 and the surface of the board receiving part 125 of the upper cover 120 are absorbed by deformation of the tips of the board pressing projections 127. This structure results in the inner board 130 being pressed against the lower cover 110 by the upper cover 120. Similarly, a plurality of board pressing projections 127 are formed on the pad corresponding recess 122 of the upper cover 120. Both the first part 131 and second part 132 of the inner board 130 are pressed against the lower cover 110 via the board pressing projections 127 of the upper cover 120 and are thus positioned with respect to the thickness direction of the card adapter 101.

Positioning posts 117 (FIG. 8E) are arranged to extend toward the upper cover 120 and are located at both sides of the pad corresponding opening 112 of the lower cover 110. Positioning recesses 137 arranged to engage the positioning posts 117 are formed on both ends of the first part 131 of the inner board 130. The inner board 130 is positioned with respect to the length and width directions of the card adapter 101 through the engagement of the positioning recesses 137 with the positioning posts 117.

A plurality of connecting projections 116 configured to protrude toward the lower cover 110 are formed on the peripheral edge of the lower cover 110 except for a portion corresponding to the opening of the card receiving receptacle 102. Similarly, a plurality of connecting recesses 126 are formed on the peripheral edge of the upper cover 120 in positions corresponding to the connecting projections 116.

When the upper cover 120 and the lower cover 110 are aligned and secured together in order to form housing 109 of the card adapter 101, each connecting projection 116 is mated to its corresponding connecting recess 126 in order to align of the upper cover 120 with lower cover 110. Bonding of the upper cover 120 and the lower cover 110 is achieved whereby, ultrasonic vibrations are applied so that the tips of the connecting projections 116 melt and are welded to the connecting recesses 126. Other methods of bonding the upper cover 120 and the lower cover 110 to each other may be utilized. For example, heat welding or the use of an adhesive may also be employed.

As described above, the insulating plate member of the inner board 130 is formed by laminating one or a plurality of plate materials comprised of a composite material such as a prepreg impregnated with an epoxy resin or one or a plurality of plate materials made of minerals or inorganic materials such as ceramics or the like on a base material such as a glass fiber, carbon fiber or the like. Thickness control is thus difficult and there are often large variations in the thickness thereof. For example, the thickness dimension of the insulating plate member of a general printed circuit board may vary in the range of ±25% of a reference value. While it is possible to reduce the thickness variation, such a reduction will cause an undesirable increase in the cost of the inner board 130. Thus, the inner boards 130 typically have significant variations in thickness. If a surface mounting system is used whereby the flat rear surface of the tail part of the terminal is soldered to the flat pad on the board, the position of the solder tail 154 of the adapter inside card connection terminal 150 with respect to the thickness direction of the card adapter 101 varies substantially in accordance with variations in the thickness of the inner board 130.

In the depicted embodiment, as described above, the insertion part 154*c* of the adapter inside card connection terminal 150 extends in the thickness or vertical direction of the card adapter 101 and is inserted into the through-hole 135 of the inner board 130 and connected thereto using a conductive binder such as solder or a conductive adhesive or the like. In this case, the position of the solder tail 154 of the adapter inside card connection terminal 150 with respect to the thickness direction of the card adapter 101 is unchanged despite variations in the thickness of the inner board 130.

Figure 9B:
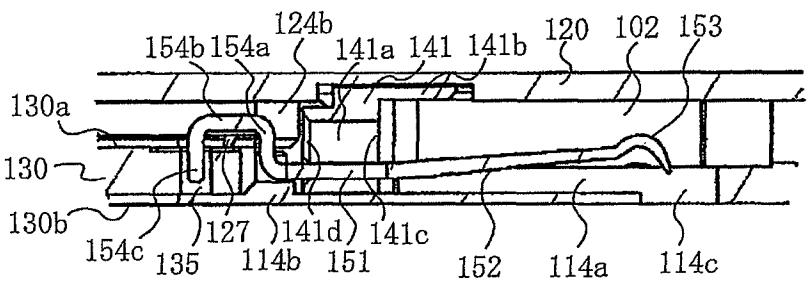
FIG. 9B is an enlarged view of the portion A indicated in FIG. 9A.
Figure 9A:
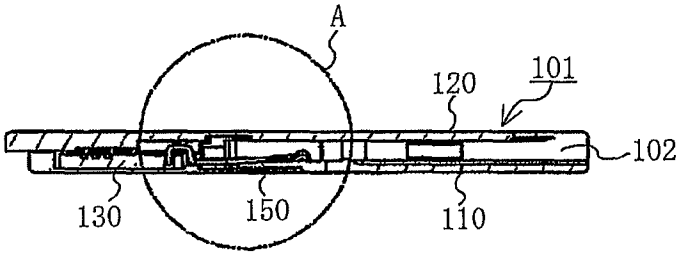
FIG. 9A is a cross-sectional view taken generally along the line X-X in FIG. 3, illustrating the connection area of a connection terminal and a relatively thick inner board.
Figure 10B:
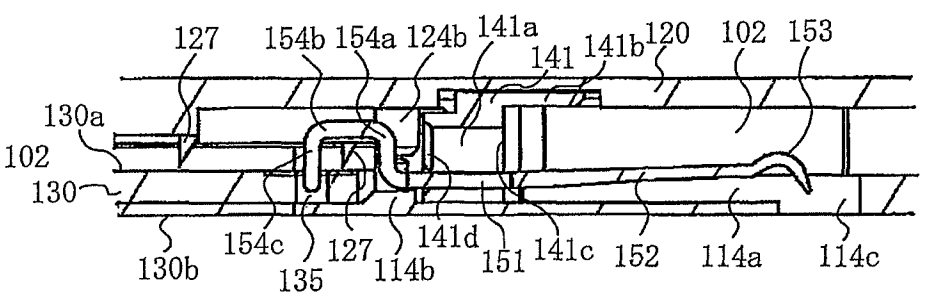
FIG. 10B is an enlarged view of the portion B indicated in FIG. 10A.
Figure 10A:
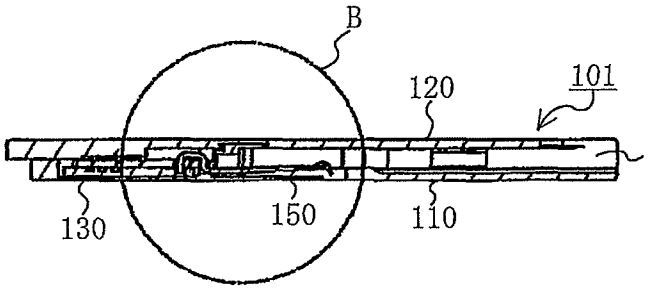
FIG. 10A is a cross-sectional view similar to that of FIG. 9A but illustrating the connection area of a connection terminal and a relatively thin inner board.

Positioning of the inner board 130 in the vertical direction is achieved by using the second surface 130*b* as a reference plane. The second surface 130*b* abuts against the surface of the board receiving part 115 of the lower cover 110. Thus, variations in the thickness of the inner board 130 appear as variations in the position of the first surface 130*a* in vertical direction. If the inner board 130 is relatively thick, the first surface 130*a* will be in a relatively high position as shown in FIG. 9B. If the inner board 130 is relatively thin, the first surface 130*a* will be in a relatively low position as shown in FIG. 10B.

Solder tail 154 is formed so that the horizontal portion 154*b* is in a sufficiently high position and the insertion part 154*c* is sufficiently long so that the position of the solder tail 154 does not rise even when the inner board 130 is thick and the insertion part 154*c* does not exit the through-hole 135 even when the inner board 130 is thin. It is thus possible to maintain the position and attitude of the adapter inside card connection terminal 150 and maintain connection between the insertion part 154*c* and the through-hole 135 regardless of the thickness of the inner board 130.

Since the position and attitude of the adapter inside card connection terminal 150 are constant irrespective of the thickness of the inner board 130, the spacing or gap between the arm part 152 and the terminal receiving groove part 114*a* are also constant. This makes it possible to maintain the consistent connection between the adapter inside card connection terminals 150 and the card side contact pads 251 of the first card 201.

Figure 11B:
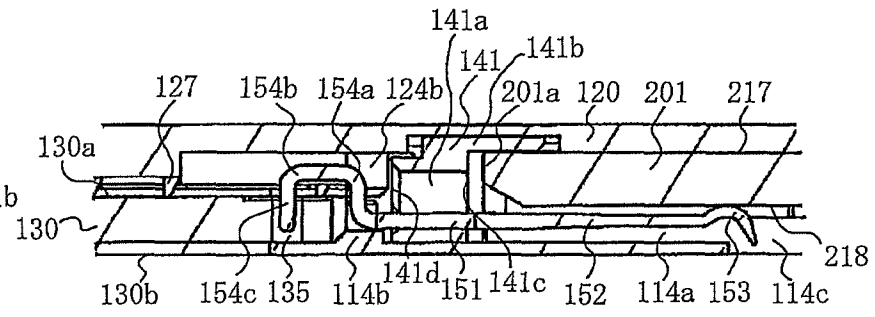
FIG. 11B is an enlarged view of portion C in FIG. 11A.
Figure 11A:
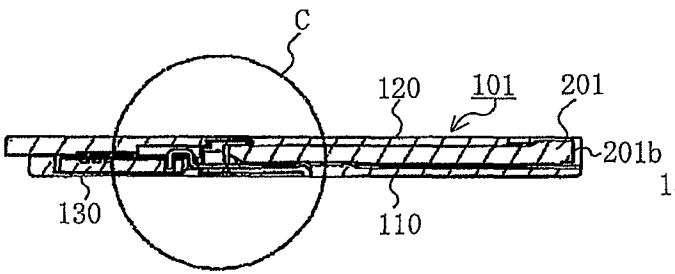
FIG. 11A is a cross-sectional view taken generally along line Y-Y in FIG. 6, illustrating the interaction between a connection terminal and the inner board together with a first card received in the card adapter of FIG. 1.

The spring arm 152 of the adapter inside card connection terminal 150 is a cantilever-shaped member having a free end thereof elastically displaceable in vertical direction. As shown in FIG. 11B, when the first card 201 is mated to the card adapter 101, the contact portion 153 connected to the free end of the arm 152 is displaced downward by the card side contact pad 251 formed on the second surface 218 of the first card 201. The arm 152 is configured to be elastically displaced downward and thus exerts a spring force upward on card side contact pad 251 to maintain contact between the contact portion 153 and the card side contact pad 251.

The spring force is substantially proportional to the displacement of the arm 152. If the gap between the arm 152 and the terminal receiving groove 114*a* is reduced, that is, if the arm 152 is located close to the card receiving base plate 111*a*, when the arm 152 abuts the card side contact pad 251 of the first card 201, the downward displacement amount of the arm part 152 will be reduced and the spring force will likewise be reduced. In such case, the contact between the contact portion 153 and the card side contact pad 251 will be unstable and result in an insecure connection between the adapter inside card connection terminal 150 and the card side contact pad 251. Due to the configuration of insertion part 154*c* of the adapter inside card connection terminal 150 and its interaction with through-hole 135 in the inner board 130, the gap between the arm 152 and the bottom surface of the terminal receiving groove part 114*a* is maintained constant to ensure consistent contact between the adapter inside card connection terminal 150 and the card side contact pad 251.

When first card 201 is inserted into the card adapter 101, the card locking bracket 161 engages recess 212 of the first card 201 and locks the first card 201 in place. The first card 201 is positioned so as not to abut against the housing 141 of the inner terminal unit 140. That is, as shown in FIG. 11B, a gap exists between the front end 201*a* of the first card 201 and card side end 141*c* of the body portion 141*a* of the housing. Thus, the position of the inner terminal unit 140 in the card adapter 101 is not intended to change before or after the first card 201 is mated.

The force provided by the card locking bracket 161 to lock the first card 201 is not excessively large. If the first card 201 is subjected to a significant external force in the insertion direction (leftward in FIG. 11B) such as if a user forces the first card 201 into the card receiving receptacle 102, the first card 201 could be moved further inward in the card receiving receptacle 102 into the gap between front end 201*a* of first card 201 and card side end 141*c* of housing 140. If the inward movement amount of the first card 201 is large enough, the front end 201*a* of the first card 201 may abut against the card side end 141*c* of the body portion 141*a* thus tending to move the body portion 141*a* inward.

In order to prevent movement of body portion 141, stop projections 114*b* are formed on the lower cover 110 and stop projections 124*b* are formed on the upper cover 120. If the body portion 141*a* undergoes an inward external force via the first card 201, a board side end 141*d* of the body portion 141*a* abuts against the stop projections 114*b* and 124*b* to hold body portion 141*a* in place. As a result, external force from first card 201 is not transmitted to the inner board 130 via the solder tail 154. This avoids possible damage to the inner terminal unit 140 and inner board 130 caused by an external force.

If the body portion 141*a* does not undergo an external force, small gaps are desirably formed between the board side end 141*d* of the body portion 141*a* and the molded stoppers 114*a* and 124*a* as shown in FIG. 11B.

If inner board 130 is thick, the first surface 130*a* is in a high position as shown in FIG. 9B, and the gap between the first surface 130*a* and the inner surface of the upper cover 120 is relatively small and the compression and deformation of the board pressing projections 127 is relatively large. If inner board 130 is thin, the first surface 130*a* is in a low position as shown in FIG. 10B, and the gap between the first surface 130*a* and the inner surface of the upper cover 120 is relatively large and compression and deformation of the board pressing projections 127 is relatively small. Regardless of whether the inner board 130 is thick or thin, the inner board 130 is pressed against the lower cover 110 via the board pressing projections 127 by the upper cover 120. It is thus possible to consistently and accurately position the inner board 130 in the vertical direction and maintain the position of the second surface 130*b* in vertical direction irrespective of the thickness of the inner board 130.

Figure 12B:
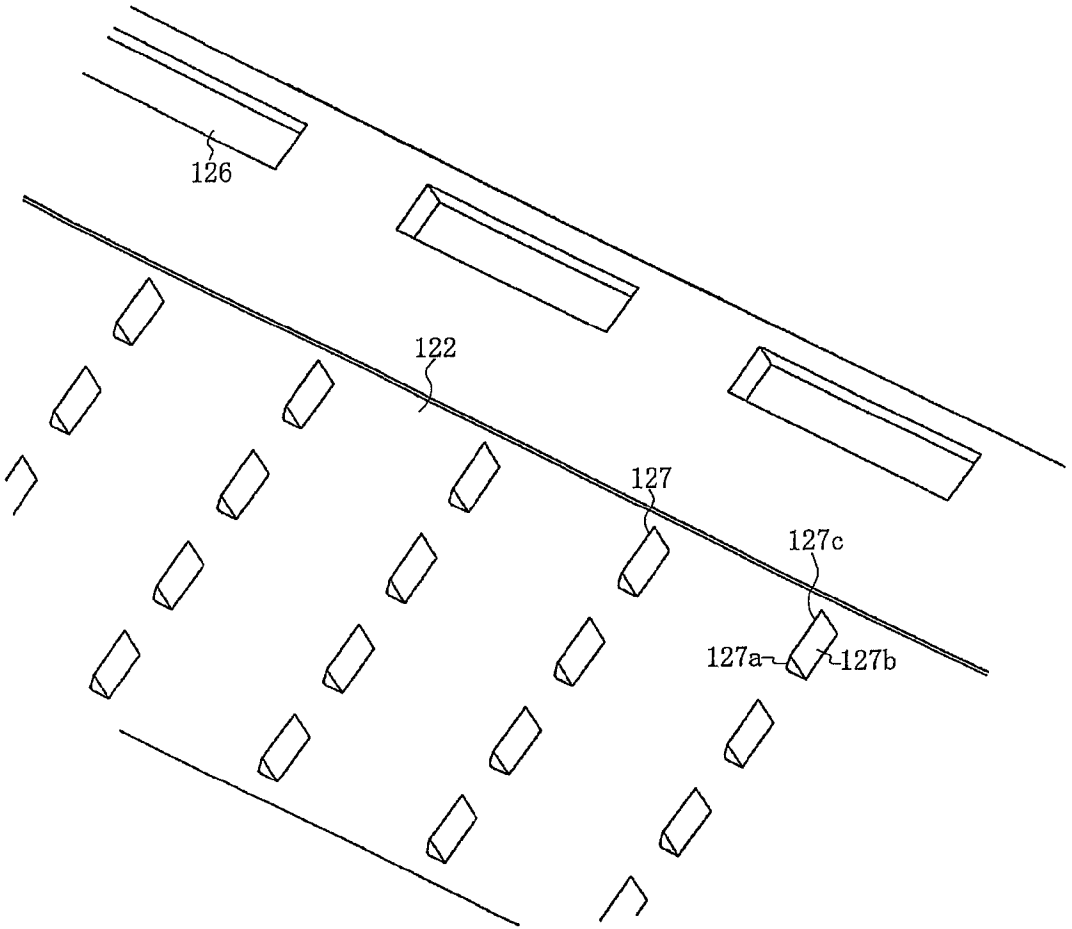
FIG. 12B is an enlarged view of a portion D indicated in FIG. 12A.
Figure 12A:
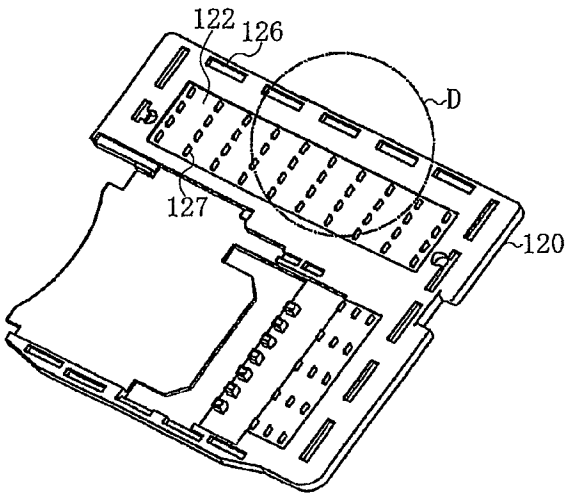
FIG. 12A is a perspective view of the inner surface of the upper cover, illustrating the board pressing projections extending therefrom.

As described above, each of the plurality of board pressing projections 127 has a sharp tip. As shown in FIGS. 12 and 13, the board pressing projections 127 have a cross section of a right triangle with a first surface 127*a* perpendicular to the surface of the pad corresponding recess 122, second inclined surface 127*b* inclined with respect to the surface of the pad corresponding recess 122 and a third bottom surface integral with the surface of the pad corresponding recess 122. The boundary between the perpendicular surface 127*a* and the inclined surface 127*b* is a ridge or tip 172*c* of the board pressing projection 127.

Figure 13A:
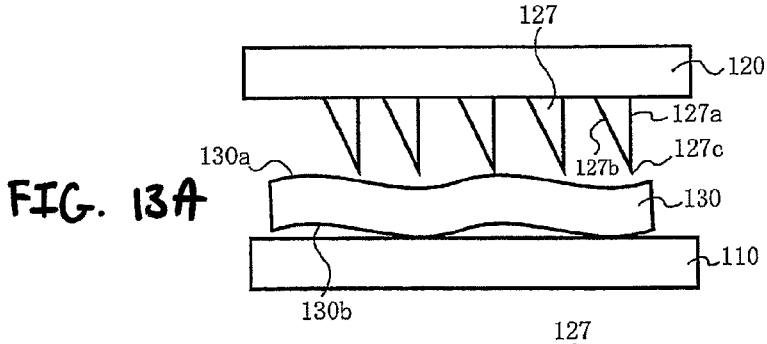
FIG. 13A is a somewhat schematic view illustrating the deformation state of the board pressing projections of the card adapter of FIG. 1 illustrating a state before the projections engage the inner board.
Figure 13B:
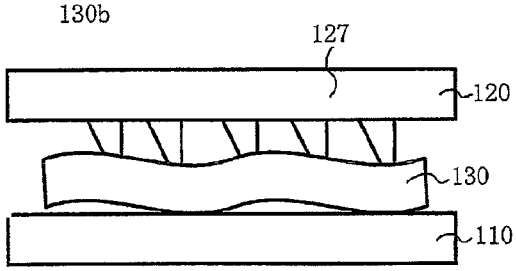
FIG. 13B is a somewhat schematic view similar to FIG. 13A but with the board pressing projections engaging the inner board.
Figure 13C:
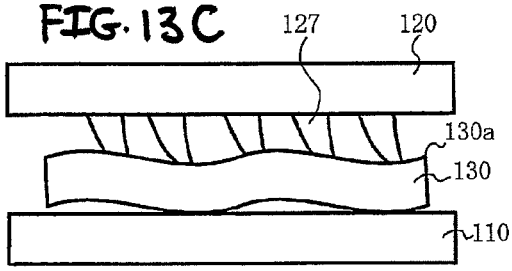
FIGS. 13C and D are somewhat schematic views similar to FIG. 13B but with the board pressing projections engaging the inner board to a different extent in order to show the inclination of such projections.
Figure 13D:
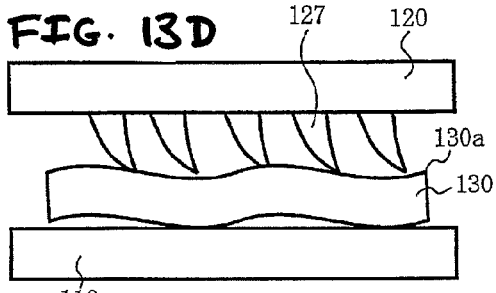
FIG. 13E is a somewhat schematic view similar to FIG. 13B but with the board pressing projections engaging a relatively thick inner board.
FIG. 13F is a somewhat schematic view similar to FIG. 13E but with the board pressing projections engaging a relatively thin inner board.
Figure 13E:
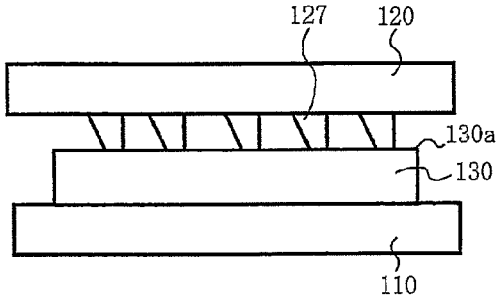
Figure 13F:
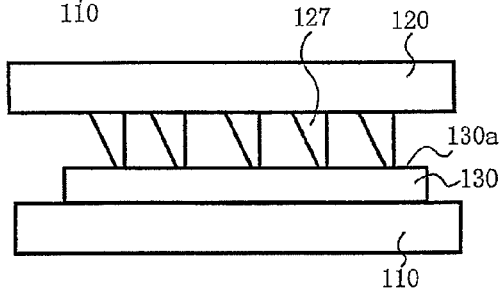

With this structure, the tips 127*c* of the board pressing projections 127 are sharp and easily deformable. When the inner board 130 is pressed against the lower cover 110 by the upper cover 120, the tip of the board pressing projections 127 are deformed and absorb any variations in the thickness of the inner board 130. If the inner board 130 is thick, the amount of the deformation of the board pressing projection 127 is relatively great as shown in FIG. 13E. If the inner board 130 is thin, the amount of deformation of the board pressing projection 127 is relatively small as shown in FIG. 13F. It is thus possible to maintain the position of the second surface 130*b* in the vertical direction by using the second surface 130*b* as a reference plane and pressing it against the inner surface of the lower cover 110 while maintaining a constant gap between the inner surface of the upper cover 120 and the inner surface of the lower cover 110 despite variations in the thickness of the inner board 130.

Furthermore, if the first surface 130*a* is uneven due to variations in thickness of the inner board 130 across the portions thereof or because of undulations or warping of the inner board 130, the tips of the board pressing projections 127 are individually deformable to absorb the unevenness or warp in the first surface 130*a*. For example, if the first surface 130*a* is uneven because of undulations in the inner board 130, board pressing projections 127 will be deformed to different extents as may be understood from a comparison of FIGS. 13A and 13B. It is thus possible to press the second surface 130*b* against the inner surface of the lower cover 110 while maintaining a constant gap between the inner surface of the upper cover 120 and the inner surface of the lower cover 110.

The central axes of the board pressing projections 127 are inclined in the direction of the perpendicular surface 127*a*. That is, the board pressing projections 127 have a cross section of a right triangle and the center axis drawn from the tip to the bottom surface is inclined in the direction of the perpendicular surface 127*a*. When the tip 127*c* of the board pressing projection 127 abuts against the first surface 130*a* of the inner board 130 and undergoes an upward force, the board pressing projection 127 is likely to be deflected in the direction consistent with inclined surface 127*b*. The perpendicular surface 127*a*, inclined surfaces 127*b* and ridges 127*c*, respectively, of each of the board pressing projections 127 are parallel to each other. In other words, the center axes of all the board pressing projections 127 are inclined to be directed toward an identical direction. As shown in FIGS. 13C and 13D, all of the board pressing projections 127 are likely to be deformed so that the tips thereof are inclined in the same direction.

The force generated by deformation of the tips and exerted on the inner board 130 is in the same direction at any board pressing projection 127. This stabilizes the inner board 130 being pressed against the inner surface of the lower cover 110 via board pressing projections 127. It is possible to exert the desired force on the inner board 130 even if the direction of inclination of the tips is different between board pressing projections 127. However, if the direction of the tips is identical as mentioned above, positioning of the inner board 130 pressed against the inner surface of the lower cover 110 via board pressing projections 127 may be more stable.

If upper cover 120 and lower cover 110 are bonded using ultrasonic welding, the applied ultrasonic vibrations are also transmitted to the board pressing projections 127. In general, ultrasonic vibrations from ultrasonic welding will tend to concentrate on the tip 127*c* of the sharp portion of the member so that the tip of the sharp portion is likely to soften. Thus, the tip 127*c* of the board pressing projections 127 will likely be heated and soften due to the ultrasonic vibrations if upper cover 120 and lower cover 110 are bonded via ultrasonic welding. The softened tips 127*c* will readily absorb variations in the thickness of the inner board 130, distortion of the first surface 130*a* or undulation of the inner board 130, and thereby keep the tips of the board pressing projections 127 from excessively pressing the inner board 130. This reduces the likelihood that the tips of the board pressing projections 127 will damage inner board 130.

Figure 14:
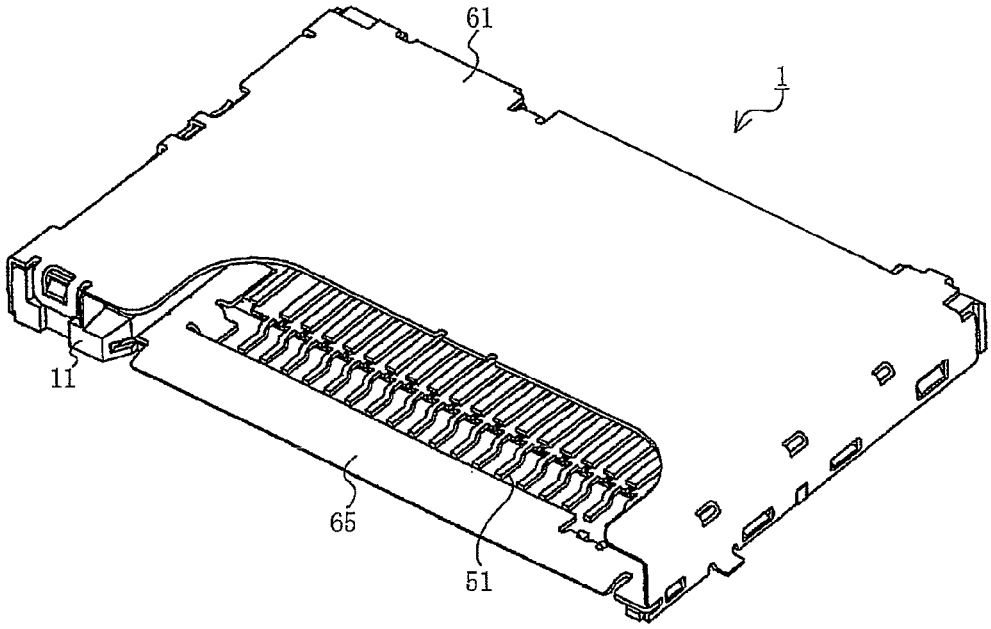
FIG. 14 is a perspective view of a card connector configured to receive the card adapter of FIG. 1.
Figure 15:
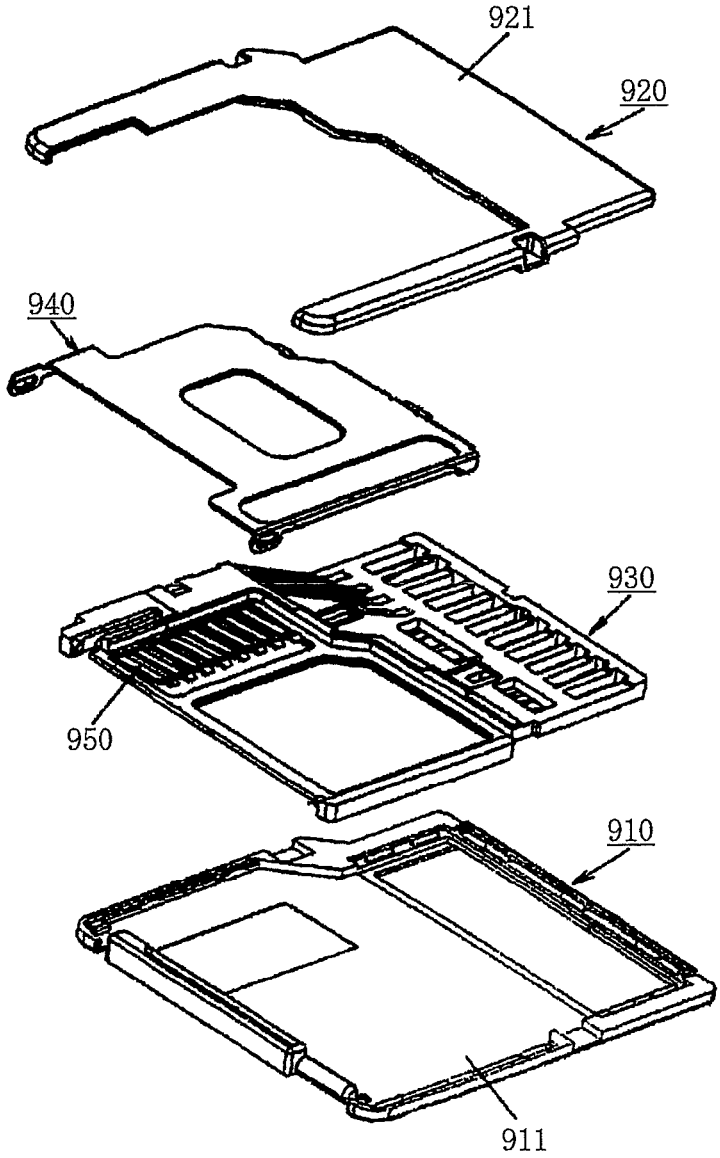
Prior art FIG. 15
FIG. 15 is a perspective view illustrating a conventional card adapter.

The card connector 1 includes a housing 11 integrally formed of an insulating material such as a synthetic resin and is capable of receiving the card adapter 101 or the second card therein. A shell 61 formed by stamping and forming sheet metal material or the like is mounted on the upper side of the housing 11 and helps to define the cavity into which card adapter 101 or the second card is inserted. As shown in FIG. 14, the card connector 1 is a generally flat rectangular structure. The card connector 1 is configured to be mounted in an electronic device or appliance and receives a card adapter 101 or second card inserted from the front (lower left in FIG. 14). In this example, it is assumed that the card adapter 101 is inserted into the card connector 1 with the surface having the adapter side contact pads 136 exposed facing down (that is, with the lower cover 110 facing down and upper cover 120 facing up). It is also assumed that the second card is inserted into the card connector 1 with the same orientation.

Terminals 51 are attached on the upper surface of the bottom wall part of the housing 11. Each terminal 51 has a base attached to the bottom wall part and a tip portion (not shown) formed at the tip of the terminal 51 and extending diagonally upward toward the inner part and protruding above the upper surface of the bottom wall part. The tip portion of each terminal 51 is configured to function as a contact portion and engage the adapter side contact pad 136 exposed from the pad corresponding opening 112 in the lower cover 110 of the card adapter 101 or card side contact pad on the second card and be electrically connected thereto. A solder tail extends from the base of the terminal 51 and protrudes forward from the front edge of the bottom wall part and is electrically connected via soldering to conductive leads, contact pads or terminals, that is, counterpart terminal members formed on a circuit board in the electronic device. A metallic ground plate 65 is located at the front edge of the housing 11.

As is known in the art, a slide member of a card guide mechanism is mounted along one side wall of housing 11 and arranged for guiding card adapter 101 or a second card inserted into the card connector 1 in a slidable manner in the insertion/ejection directions.

The slide member includes an engaging projection part (not shown) that engages recess part 108 of the card adapter 101 or a recess part of the second card. The slide member holds the card adapter 101 or the second card while it moves along the insertion/ejection path to also move card adapter 101 or the second card. The slide member is urged by a spring member (not shown) in a direction opposite to the insertion direction of the card adapter 101 or the second card in order to bias the card adapter 101 or second card out of connector 1.

The card connector 1 is a so-called push-in/push-out type or a push/push type that requires the operation of pushing the card adapter 101 or second card when the card adapter 101 or second card is inserted into the card connector 1 or when the card adapter 101 or second card is to be ejected from card connector 1. When the card adapter 101 or second card moves in the insertion direction and reaches an end point by the push operation, the card guide mechanism moves the card adapter 101 or second card, using the biasing force of the urging member, in a direction opposite to the insertion direction and ejects the card adapter 101 or second card.

If required, card adapter 101 could be modified so that first card 201 could be mated to card adapter 101 in an upside down orientation, that is, with the second surface 218 facing the upper cover 120 and the upper surface 217 facing the lower cover 110. In such case, the terminal receiving grooves 114*a* and the terminal tip receiving recesses 114*c* are formed in the terminal receiving part 124 of the upper cover 120. The base 151 of the adapter inside card connection terminal 150 is positioned near the inner surface of the upper cover 120 and the arm 152 diagonally extends downward from the base 151, that is, in a direction to approach the lower cover 110. The transition portion 154*a* of the solder tail 154 is omitted so that the solder tail 154 has an L-letter shaped side face. The solder tail 154 includes a horizontal portion 154*b* extending from and parallel to the base 151 and an insertion part 154*c* having an upper end connected to the tip of the horizontal portion 154*b* and extending downward substantially perpendicularly to the base 151. The insertion part 154*c* is inserted into the through-hole 135 in the inner board 130 from the side of the upper cover 120 electrically connected to the leads 133. The card locking bracket 161 is moved to a position corresponding to the recess 212 of the first card 201 on the opposite side of card receiving receptacle 111.

The present invention is not limited to the above-described embodiments, and may be changed in various ways based on the gist of the present invention, and these changes are not eliminated from the scope of the present invention.

What is claimed is:

1. A card adapter configured to receive a first card and be inserted into a card connector into which a second card may be mated, the card adapter comprising:

a housing, the housing including first and second intermateable insulative plate members;

a circuit member arranged in the housing, the circuit member including a plurality of adapter side contact pads, each contact pad being configured to contact a terminal of the card connector, and a plurality of conductive leads, each lead extending between one of the contact pads and a termination end; and a plurality of connection terminals, each terminal being connected to one of the termination ends and configured to engage a contact pad of the first card;

wherein the first plate member includes a plurality of deformable projections configured to engage a first surface of the circuit member, the deformable projections pressing the circuit member against the second plate member to allow the circuit member to contact the terminal of the card connector.

2. The card adapter according to claim 1, wherein the second plate member includes a board receiving recess for receiving at least a portion of the circuit member.

3. The card adapter according to claim 1, wherein each projection has a sharp tip.

4. The card adapter according to claim 1, wherein each projection has a central axis inclined in an identical direction.

5. The card adapter according to claim 1, wherein the projections are arranged in grid-like pattern.

6. The card adapter according claim 1, wherein a tip of each projection is deformed due to application of ultrasonic vibrations for coupling the first plate member and the second plate member.

7. The card adapter according to claim 2, wherein the circuit member abuts against a reference surface of the board receiving recess, thereby positioning the circuit member in a thickness direction of the housing.

8. A card adapter configured to receive a first card and to be inserted into a card connector in an insertion direction, the card adapter comprising:

a housing, the housing including first and second intermateable, insulative cover members and a receptacle for receiving the first card, the second cover member including a board receiving recess;

a circuit board positioned in the housing with at least a portion thereof located in the board receiving recess, the circuit board including a plurality of adapter side contact pads, each contact pad being configured to contact a terminal of the card connector, and a plurality of conductive leads, each lead extending between one of the contact pads and a termination end; and a plurality of deflectable, conductive terminals positioned in the housing, each terminal being connected to one of the termination ends and extending into the receptacle, and engaging a contact pad of the first card in the receptacle;

wherein the first cover member includes a plurality of deformable projections configured to engage a first surface of the circuit member, the deformable projections pressing the circuit member against a reference plane of the second cover member adjacent the board receiving recess to allow the circuit member to contact the terminal of the card connector, the circuit member being positioned in a direction transverse to the insertion direction.

9. The card adapter according to claim 8, wherein each projection has a shape with a sharp tip.

10. The card adapter according to claim 8, wherein each projection has a central axis inclined in an identical direction.

11. The card adapter according to claim 8, wherein the plurality of projections are arranged in grid-like pattern.

12. The card adapter according to claim 8, wherein the projections are arranged in two, spaced apart grid-like patterns.

13. The card adapter according claim 8, wherein a tip of each projection is deformed due to application of ultrasonic vibrations for coupling the first cover member and the second cover member.

14. A card adapter configured to receive a first card and be inserted into a card connector into which a second card may be mated, the card adapter comprising:

a housing, the housing including first and second intermateable insulative plate members;

a circuit member within the housing, the circuit member including a plurality of adapter side contact pads, each contact pad being configured to contact a terminal of the card connector, and a plurality of conductive leads, each lead extending between one of the contact pads and a termination end, each termination end having a through-hole extending through the circuit member; and a plurality of conductive connection terminals, each terminal including a deflectable contact end configured to engage a conductive contact pad of the first card and a solder tail configured to extend into one of the through-holes;

wherein each through-hole includes a conductive land disposed thereon to allow connection between one of the conductive leads and one of the solder tails;

wherein the first plate member includes a board receiving recess for receiving at least a part of the circuit member therein, and wherein the circuit member is arranged such that a second surface thereof abuts a surface of the board receiving recess to align the circuit member in a thickness direction of the housing.

15. The card adapter according to claim 14, wherein each terminal further includes:

a base held by an insulative terminal holding member;

a resilient spring arm having one end fixed to the base and another end having the contact end, disposed thereon; and a board connection part connected to one end of the base opposite the end to which the spring arm is connected, the board connection part including the solder tail.

16. The card adapter according to claim 15, wherein the board connection part further includes a horizontal part having one end connected to the solder tail and extending substantially parallel to a first surface of the circuit member the spring arm extends from the base at an angle so that the contact end approaches one of the first and second plate members.

17. The card adapter according to claim 15, wherein the board connection part further includes a transition section having one end connected to the base and a second end connected to the horizontal part, the transition section extends along an insertion direction of the first card, the board connection part being generally U-shaped.

18. The card adapter according to claim 16, wherein the spring arm extends from the base at an angle so that the contact end approaches one of the first and second plate members.

* * * * *